US009538593B2

(12) United States Patent
Zhang

(10) Patent No.: US 9,538,593 B2
(45) **Date of Patent: *Jan. 3, 2017**

(54) METHOD FOR MULTIPLYING CURRENT OF LED LIGHT BAR AND ASSOCIATED DRIVING CIRCUIT THEREOF

(71) Applicant: Hua Zhang, Shenzhen (CN)

(72) Inventor: Hua Zhang, Shenzhen (CN)

(73) Assignee: SHENZHEN CHINA STAR OPTOELECTRONICS TECHNOLOGY CO., LTD., Shenzhen, Guangdong Province (CN)

( * ) Notice: Subject to any disclaimer, the term of this patent is extended or adjusted under 35 U.S.C. 154(b) by 31 days.

This patent is subject to a terminal disclaimer.

(21) Appl. No.: 13/807,717

(22) PCT Filed: Nov. 22, 2012

(86) PCT No.: PCT/CN2012/084996

§ 371 (c)(1),
(2) Date: Dec. 28, 2012

(87) PCT Pub. No.: WO2014/075326

PCT Pub. Date: May 22, 2014

(65) Prior Publication Data

US 2014/0132173 A1 May 15, 2014

(30) Foreign Application Priority Data

Nov. 14, 2012 (CN) ..... 2012 1 0457506

(51) Int. Cl.
*H05B 33/08* (2006.01)

(52) U.S. Cl.
CPC ..... *H05B 33/0818* (2013.01)

(58) Field of Classification Search
CPC ... H05B 37/02; H05B 33/083; H05B 33/0845; H05B 33/0827; H05B 33/0809; H05B 33/089; H05B 33/0815; H05B 33/0857; H05B 33/0818; H05B 33/0812; H05B 33/0824; H05B 37/0272; H05B 41/2828; H05B 41/2851; H05B 41/2856; H05B 41/295

(Continued)

(56) References Cited

U.S. PATENT DOCUMENTS 7,262,582 B2 * 8/2007 Warita et al. ..... 323/222
7,327,051 B2 * 2/2008 Ito et al. ..... 307/10.8

(Continued)

FOREIGN PATENT DOCUMENTS

CN 201947497 U 8/2011
CN 102612235 A 7/2012

(Continued)

*Primary Examiner* — Douglas W Owens
*Assistant Examiner* — Wei Chan
(74) *Attorney, Agent, or Firm* — Cheng-Ju Chiang

(57) ABSTRACT

The present invention provides a method for multiplying current of an LED light bar, which includes (1) providing a constant current driving chip that includes driving modules each having first to three pins and resistors; (2) providing an LED light bar, a power source, and a PWM control source; (3) connecting an end of one resistor to the third pin of one driving module and an opposite end grounded, connecting the first pin of the driving module to the negative terminal of the light bar, connecting the second pin of the driving module to the PWM control source, and connecting the positive terminal of the light bar to the power source; (4) repeating step (3) as necessary to have multiple driving modules electrically connected to the light bar; (5) activating the power source and the PWM control source to allow the driving modules to simultaneous drive the light bar.

11 Claims, 3 Drawing Sheets

(58) Field of Classification Search
USPC .... 315/294, 291, 246, 250, 307, 185 R, 210
See application file for complete search history.

(56) References Cited

U.S. PATENT DOCUMENTS

| | | | | |
|---|---|---|---|---|
| 7,705,543 | B2 * | 4/2010 | Ragonesi et al. | 315/209 R |
| 7,740,371 | B1 * | 6/2010 | Lebens et al. | 362/205 |
| 7,741,788 | B2 * | 6/2010 | Ito et al. | 315/247 |
| 7,919,925 | B2 * | 4/2011 | Ito et al. | 315/82 |
| 8,044,609 | B2 * | 10/2011 | Liu | 315/291 |
| 8,183,786 | B2 * | 5/2012 | Park et al. | 315/169.3 |
| 8,253,352 | B2 * | 8/2012 | Liu | 315/307 |
| 8,324,816 | B2 * | 12/2012 | Ohashi et al. | 315/127 |
| 8,410,711 | B2 * | 4/2013 | Lin et al. | 315/224 |
| 8,471,499 | B2 * | 6/2013 | Um et al. | 315/307 |
| 8,564,219 | B2 * | 10/2013 | Lee et al. | 315/291 |
| 8,648,548 | B2 * | 2/2014 | Sakai | 315/307 |
| 8,786,194 | B2 * | 7/2014 | Shin | 315/122 |
| 2004/0164685 | A1 * | 8/2004 | Dygert | 315/224 |
| 2004/0212310 | A1 * | 10/2004 | Ito et al. | 315/77 |
| 2005/0151717 | A1 * | 7/2005 | Seo | 345/102 |
| 2006/0197722 | A1 * | 9/2006 | Nakajima | 345/83 |
| 2006/0238466 | A1 * | 10/2006 | Chen et al. | 345/82 |
| 2007/0085786 | A1 * | 4/2007 | Lin et al. | 345/82 |
| 2008/0203946 | A1 * | 8/2008 | Ito et al. | 315/307 |
| 2008/0315778 | A1 * | 12/2008 | Tatsukawa | 315/193 |
| 2009/0009088 | A1 * | 1/2009 | Ito et al. | 315/77 |
| 2009/0284175 | A1 * | 11/2009 | Park et al. | 315/294 |
| 2010/0072898 | A1 * | 3/2010 | Ohashi et al. | 315/127 |
| 2010/0072903 | A1 * | 3/2010 | Blaut et al. | 315/185 R |
| 2010/0102756 | A1 * | 4/2010 | Shin et al. | 315/297 |
| 2010/0148683 | A1 * | 6/2010 | Zimmermann | H05B 33/0866 315/224 |
| 2010/0164403 | A1 * | 7/2010 | Liu | 315/297 |
| 2011/0204802 | A1 * | 8/2011 | Welten | 315/193 |
| 2011/0215731 | A1 * | 9/2011 | Jeong et al. | 315/254 |
| 2011/0248648 | A1 * | 10/2011 | Liu | 315/294 |
| 2012/0013267 | A1 * | 1/2012 | Yoshio et al. | 315/297 |
| 2012/0119659 | A1 * | 5/2012 | Lee et al. | 315/152 |
| 2012/0146546 | A1 * | 6/2012 | Hu et al. | 315/297 |
| 2012/0169417 | A1 * | 7/2012 | Sakai | 330/69 |
| 2012/0176052 | A1 * | 7/2012 | Chen et al. | 315/193 |
| 2012/0212144 | A1 * | 8/2012 | Hayashi et al. | 315/193 |
| 2012/0256554 | A1 * | 10/2012 | Um et al. | 315/224 |
| 2012/0299484 | A1 * | 11/2012 | Shin | 315/122 |
| 2013/0082624 | A1 * | 4/2013 | Brassfield et al. | 315/297 |
| 2013/0135774 | A1 * | 5/2013 | Li | 361/18 |
| 2013/0162153 | A1 * | 6/2013 | van de Ven et al. | 315/193 |
| 2013/0322059 | A1 * | 12/2013 | Gao et al. | 362/97.1 |
| 2014/0009455 | A1 * | 1/2014 | Li et al. | 345/212 |
| 2014/0016304 | A1 * | 1/2014 | Gao et al. | 362/97.2 |
| 2014/0055051 | A1 * | 2/2014 | Raval et al. | 315/193 |
| 2014/0062321 | A1 * | 3/2014 | McMahon | 315/192 |
| 2014/0097753 | A1 * | 4/2014 | Hui et al. | 315/112 |
| 2014/0184078 | A1 * | 7/2014 | Hwang et al. | 315/122 |
| 2014/0197759 | A1 * | 7/2014 | Wray | 315/297 |

FOREIGN PATENT DOCUMENTS

| | | | |
|---|---|---|---|
| CN | 202404873 | U | 8/2012 |
| CN | 102682719 | A | 9/2012 |
| CN | 102682721 | A | 9/2012 |
| CN | 102711331 | A | 10/2012 |

* cited by examiner

METHOD FOR MULTIPLYING CURRENT OF LED LIGHT BAR AND ASSOCIATED DRIVING CIRCUIT THEREOF

BACKGROUND OF THE INVENTION

1. Field of the Invention

The present invention relates to the field of liquid crystal display, and in particular to a method for multiplying current of an LED light bar and associated driving circuit thereof.

2. The Related Arts

LED is a solid state light source, which uses re-combination of electrons and electron holes in a semiconductor to emit photons. The color emitting from an LED is determined by the energy of photons and the energy of photons is determined by the material used. The same material gives substantially identical wavelength of the emitted light and thus, each LED gives off a pure color. The most commonly known LEDs of regular brightness include red color and green color. The LEDs have small sizes of die, have diversified colors, and provide significant flexibility in arrangement for use, these being the factors making them superior to the ordinary light source. Further, compared to the other light sources, the LEDs also provide relatively high light efficiency and relatively high reliability and the way of power supplying thereto is relatively simple. Thus, the LEDs are particularly fit to serving as a light source for displaying.

Similar to a PN junction of a regular semiconductor, voltage drop of forward conduction of an LED hardly varies with conduction current and is generally approximately 3.5V, but the illumination increases with the increase of the current flowing therethrough, so that the larger the current is, the larger the optic output and illumination will be. Thus, LEDs must use serially-connected power supply and a constant current power supply, so that the electrical current flowing through the diode is constant in order to maintain stable optical output. For a driving chip for LEDs, the output must feature constant current to power serially connected LEDs. Thus, using an LED constant current driving chip to drive an LED light bar is thus put into use.

Referring to FIG. 1, in the state of the art, when electricity is applied to an LED constant current driving chip, a constant voltage is generated therein. This voltage and a resistance R100 that is externally connected to a current setting pin of the constant current driving chip 200 collectively determine the current flowing through an LED light bar 100. Being constrained by the semiconductor manufacturing process and the issue of heat emission, the maximum current that an individual channel of the LED constant current driving chips 200 available from every manufacturer can take is 300 mA. With the progress of science and technology, currently, the size of liquid crystal display panel is getting larger and larger and higher and higher backlight luminance is desired for the liquid crystal display panel. The conventional LED backlight driving circuits often uses an individual constant current driving module contained in an LED constant current driving chip to drive a single LED light bar, this making it impossible for the current flowing through the LED light bar to reach a level exceeding 300 mA. Due to such a limitation of the driving current, the LED light bar cannot provide a brighter light source and does not meet the need of large-sized liquid crystal displays.

SUMMARY OF THE INVENTION

An object of the present invention is to provide a method for multiplying current of an LED light bar, which increases the electrical current flowing through the LED light bar and improve the luminance of the LED light bar so as to provide a brighter backlight to meet the need of large-sized liquid crystal displays.

Another object of the present invention is to provide an LED light bar driving circuit, which has a simple circuit structure, increases the electrical current flowing through an LED light bar, and improves the luminance of the LED light bar so as to provide a brighter backlight to meet the need of large-sized liquid crystal displays.

To achieve the objects, the present invention provides a method for multiplying current of an LED light bar, which comprises the following steps:

(1) providing a constant current driving chip and a plurality of resistors, wherein the constant current driving chip comprises a plurality of constant current driving modules and each of the constant current driving modules comprises first to third pins;

(2) providing an LED light bar, a power source, and a PWM control source, wherein the LED light bar has a positive terminal and a negative terminal;

(3) connecting an end of one of the resistors to the third pin of one of the constant current driving modules and an opposite end to a ground line, connecting the first pin of the constant current driving module to the negative terminal of the LED light bar, connecting the second pin of the constant current driving module to a PWM control source, and connecting the positive terminal of the LED light bar to a power source;

(4) repeated step (3) multiple times as necessary to have a plurality of constant current driving modules electrically connected to the LED light bar, the plurality of resistors, the power source, and the PWM control source; and (5) activating the power source and the PWM control source in order to allow the plurality of constant current driving modules to simultaneously drive the same LED light bar to give off light.

The constant current driving modules contained in the constant current driving chip are of a number greater than two and the resistors have a number corresponding to the number of the constant current driving modules contained in the constant current driving chip.

Each of the constant current driving modules comprises a field-effect transistor and a voltage comparator electrically connected to the field-effect transistor. The field-effect transistor comprising a gate terminal, a source terminal, and a drain terminal. The drain terminal is electrically connected to the negative terminal of the LED light bar. The gate terminal is electrically connected to the voltage comparator. The source terminal is electrically connected to the resistor on the third pin of the constant current driving module.

The voltage comparator comprises a positive pin, a negative pin, and an output pin. The positive pin is electrically connected to the PWM control source. The negative pin is electrically connected to the source terminal of the field-effect transistor. The output pin is electrically connected to the gate terminal of the field-effect transistor.

The PWM control source supplies high level and low level. The high level is greater than voltage of the source terminal when the field-effect transistor is normally conducted on. The low level is less than the voltage of the source terminal when the field-effect transistor is normally conducted on. The output voltage of the voltage comparator is greater than a threshold voltage of the field-effect transistor.

The present invention also provides an LED light bar driving circuit, which comprises a constant current driving chip, a plurality of resistors, an LED light bar, a power source, and a PWM control source. The constant current driving chip comprises a plurality of constant current driving modules. Each of the constant current driving modules comprises first to third pins. The LED light bar has a positive terminal and a negative terminal. The positive terminal of the LED light bar is electrically connected to the power source. Each of the resistors has an end connected to the third pin of one of the constant current driving modules and an opposite end connected to a ground line. The first pin of the constant current driving module that comprises the resistor connected thereto is connected to the negative terminal of the LED light bar. The second pin is connected to the PWM control source.

The constant current driving modules contained in the constant current driving chip are of a number greater than two and the resistors have a number corresponding to the number of the constant current driving modules contained in the constant current driving chip.

Each of the constant current driving modules comprises a field-effect transistor and a voltage comparator electrically connected to the field-effect transistor. The field-effect transistor comprising a gate terminal, a source terminal, and a drain terminal. The drain terminal is electrically connected to the negative terminal of the LED light bar. The gate terminal is electrically connected to the voltage comparator. The source terminal is electrically connected to the resistor on the third pin of the constant current driving module.

The voltage comparator comprises a positive pin, a negative pin, and an output pin. The positive pin is electrically connected to the PWM control source. The negative pin is electrically connected to the source terminal of the field-effect transistor. The output pin is electrically connected to the gate terminal of the field-effect transistor.

The PWM control source supplies high level and low level. The high level is greater than voltage of the source terminal when the field-effect transistor is normally conducted on. The low level is less than the voltage of the source terminal when the field-effect transistor is normally conducted on. The output voltage of the voltage comparator is greater than a threshold voltage of the field-effect transistor.

The present invention further provides a method for multiplying current of an LED light bar, which comprises the following steps:

(1) providing a constant current driving chip and a plurality of resistors, wherein the constant current driving chip comprises a plurality of constant current driving modules and each of the constant current driving modules comprises first to third pins;

(2) providing an LED light bar, a power source, and a PWM control source, wherein the LED light bar has a positive terminal and a negative terminal;

(3) connecting an end of one of the resistors to the third pin of one of the constant current driving modules and an opposite end to a ground line, connecting the first pin of the constant current driving module to the negative terminal of the LED light bar, connecting the second pin of the constant current driving module to a PWM control source, and connecting the positive terminal of the LED light bar to a power source;

(4) repeated step (3) multiple times as necessary to have a plurality of constant current driving modules electrically connected to the LED light bar, the plurality of resistors, the power source, and the PWM control source; and (5) activating the power source and the PWM control source in order to allow the plurality of constant current driving modules to simultaneously drive the same LED light bar to give off light;

wherein the constant current driving modules contained in the constant current driving chip are of a number greater than two and the resistors have a number corresponding to the number of the constant current driving modules contained in the constant current driving chip;

wherein each of the constant current driving modules comprises a field-effect transistor and a voltage comparator electrically connected to the field-effect transistor, the field-effect transistor comprising a gate terminal, a source terminal, and a drain terminal, the drain terminal being electrically connected to the negative terminal of the LED light bar, the gate terminal being electrically connected to the voltage comparator, the source terminal being electrically connected to the resistor on the third pin of the constant current driving module;

wherein the voltage comparator comprises a positive pin, a negative pin, and an output pin, the positive pin being electrically connected to the PWM control source, the negative pin being electrically connected to the source terminal of the field-effect transistor, the output pin being electrically connected to the gate terminal of the field-effect transistor; and wherein the PWM control source supplies high level and low level, the high level being greater than voltage of the source terminal when the field-effect transistor is normally conducted on, the low level being less than the voltage of the source terminal when the field-effect transistor is normally conducted on, the output voltage of the voltage comparator being greater than a threshold voltage of the field-effect transistor.

The efficacy of the present invention is that the present invention provides a method for multiplying current of an LED light bar that uses two or more than two constant current driving modules to simultaneously a single LED light bar so as to increase the electrical current flowing through the LED light bar and improve the luminance of the LED light bar so as to provide a brighter backlight source to meet the need of large-sized liquid crystal displays. The present invention also provides an LED light bar driving circuit, which has a simple structure, increases the electrical current flowing through an LED light bar, and improves the luminance of the LED light bar so as to provide a brighter backlight to meet the need of large-sized liquid crystal displays.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
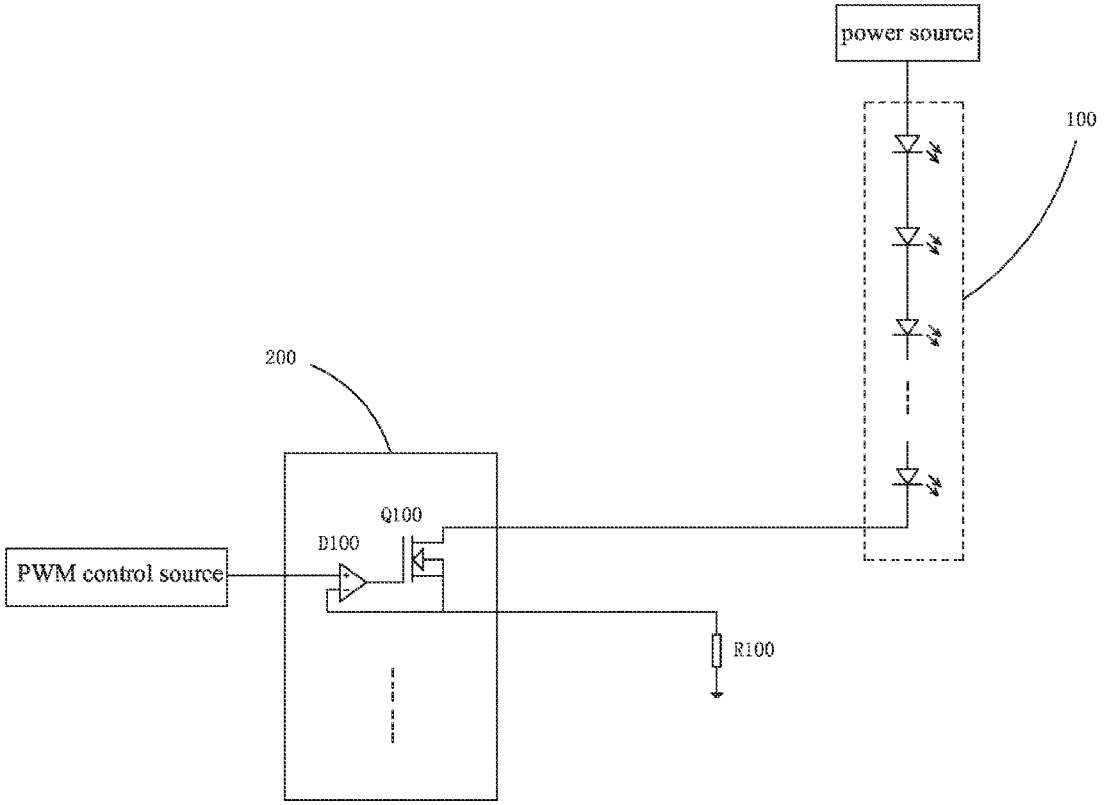
Fig. 1 (Prior Art)
FIG. 1 is a circuit diagram of a conventional constant current driving module driving an LED light bar.
Figure 2:
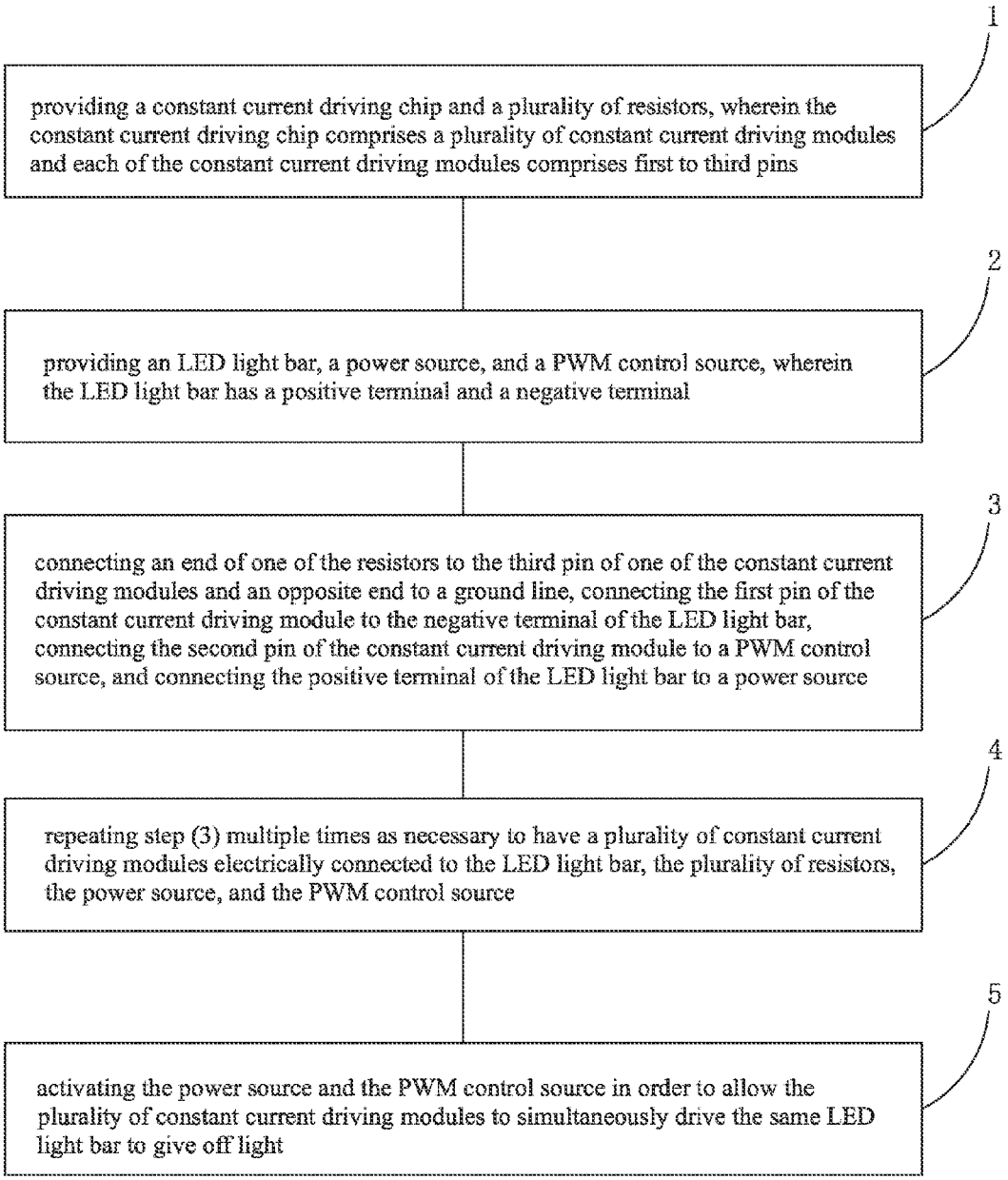
FIG. 2 is a flow chart illustrating a method for multiplying current of an LED light bar according to the present invention.
Figure 3:
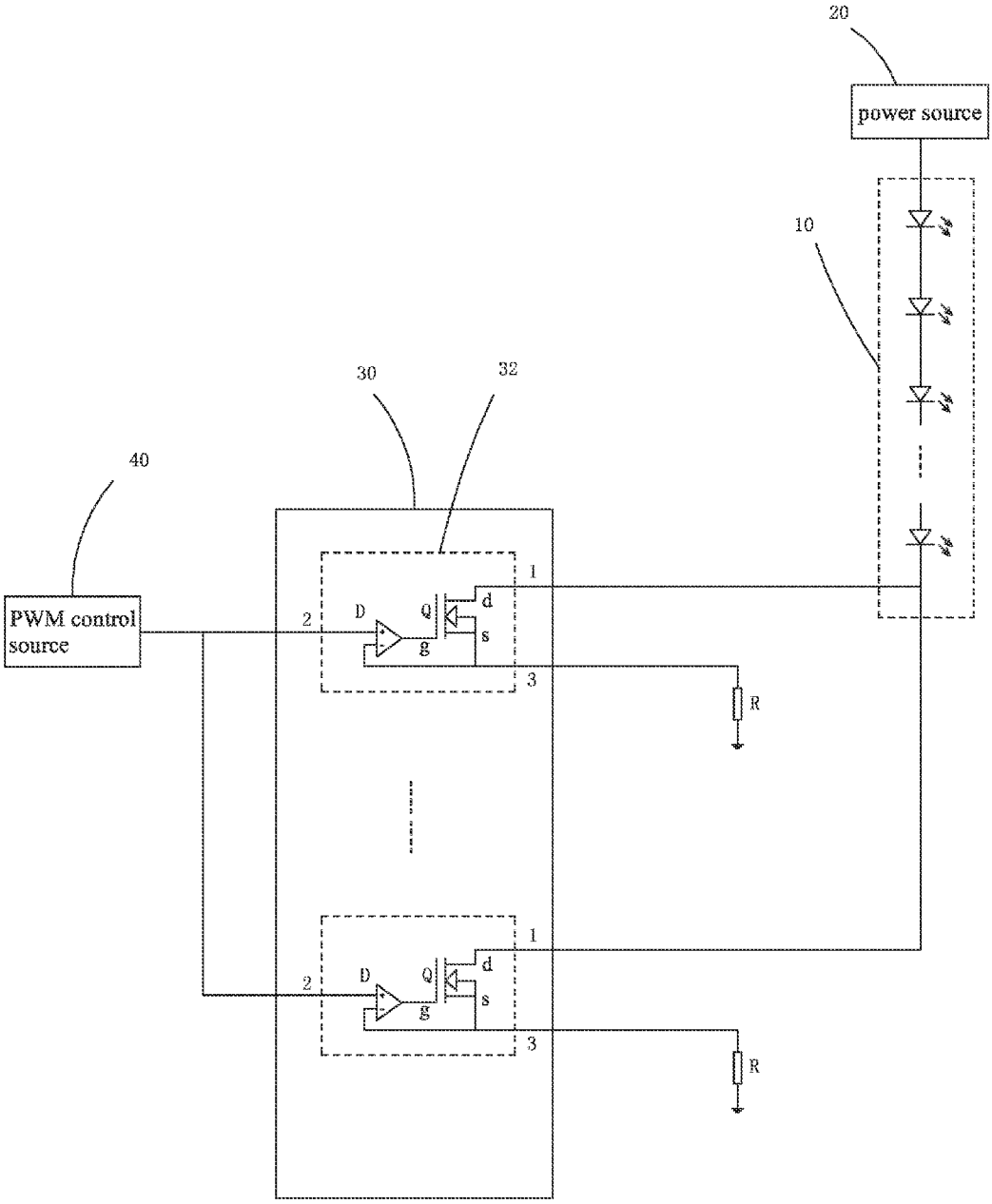
FIG. 3 is a circuit diagram of a plurality of constant current module simultaneously driving a single LED light bar according to the present invention.

Referring to FIGS. 2 and 3, the present invention provides a method for multiplying current of an LED light bar, which comprises the following steps:

Step 1: providing a constant current driving chip 30 and a plurality of resistors R, wherein the constant current driving chip 30 comprises a plurality of constant current driving modules 32 and each of the constant current driving modules 32 comprises first to third pins 1-3.

The resistances of the resistors R are each determined according to the desired luminance of an LED light bar 10 associated therewith. In other words, through setting the resistances of the resistors R, electrical current flowing through the LED light bar 10 can be adjusted thereby adjusting the lighting luminance of the LED light bar 10. In the instant preferred embodiment, the constant current driving modules 32 contained in the constant current driving chip 30 are of a number greater than two. The resistors R have a number corresponding to the number of the constant current driving modules 32 contained in the constant current driving chip 30 so as to ensure that at least two constant current driving modules 32 are simultaneously driving a single LED light bar 10.

Step 2: providing an LED light bar 10, a power source 20, and a PWM (Pulse Width Modulation) control source 40, wherein the LED light bar 10 has a positive terminal and a negative terminal.

The LED light bar 10 comprises a circuit board and a plurality of LED lights (not shown) mounted on the circuit board and electrically connected to the circuit board.

The PWM control source 40 supplies high level and low level. The high level is greater than voltage of a source terminal s when a field-effect transistor Q is normally conducted on. The low level is less than the voltage of the source terminal s when the field-effect transistor Q is normally conducted on so as to ensure that when a high level is applied to a positive pin of a voltage comparator D, the voltage comparator D outputs a high level to drive the field-effect transistor Q and when a low level is applied to the positive pin of the voltage comparator D, the voltage comparator output a low level and the low level is incapable of conducting on the field-effect transistor Q. The output voltage of the voltage comparator D is greater than a threshold voltage of the field-effect transistor Q in order to ensure that the output voltage of the voltage comparator can properly drive the field-effect transistor Q to switch the field-effect transistor Q between conduction condition and cutoff condition.

Step 3: connecting an end of one of the resistors R to the third pin of one of the constant current driving modules 32 and an opposite end to a ground line, connecting the first pin 1 of the constant current driving module 32 to the negative terminal of the LED light bar 10, connecting the second pin of the constant current driving module 32 to a PWM control source 40, and connecting the positive terminal of the LED light bar 10 to a power source 20.

Each of the constant current driving modules 32 comprises a field-effect transistor Q and a voltage comparator D electrically connected to the field-effect transistor Q. The field-effect transistor Q comprises a gate terminal g, a source terminal s, and a drain terminal d. The drain terminal d is electrically connected to the negative terminal of the LED light bar 10. The gate terminal g is electrically connected to the voltage comparator D. The source terminal s is electrically connected to the resistor R on the third pin 3 of the constant current driving module 32. Using conduction and cutoff of the field-effect transistor Q to control the LED light bar 10 to conduct on or cut off is safe and reliable, providing the switch with elongated lifespan. The voltage comparator D comprises a positive pin, a negative pin, and an output pin. The positive pin is electrically connected to the PWM control source 40. The negative pin is electrically connected to the source terminal s of the field-effect transistor Q. The output pin is electrically connected to the gate terminal g of the field-effect transistor Q. A stable voltage is supplied through the voltage comparator D to drive the field-effect transistor Q.

Step 4: repeated Step 3 multiple times as necessary to have a plurality of constant current driving modules 32 electrically connected to the LED light bar 10, the plurality of resistors R, the power source 20, and the PWM control source 40.

Repeating Step 3 multiple times allow a plurality of constant current driving modules 32 to simultaneously drive the same LED light bar 10. The plurality of constant current driving modules 32 splits the electrical current flowing through the LED light bar 10 so that the electrical current flowing through the LED light bar 10 is not limited by the maximum current available to an individual constant current driving module 32.

Step 5: activating the power source 20 and the PWM control source 40 in order to allow the plurality of constant current driving modules 32 to simultaneously drive the same LED light bar 10 to give off light.

The present invention uses two or more than two constant current driving modules 32 to simultaneously drive the same LED light bar 10 so as to be able to increase the electrical current flowing through the LED light bar 10 without being limited by the maximum current available to an individual constant current driving module 32 and thereby increasing the luminance of the LED light bar 10 and providing a brighter light source to meet the needs of large-sized liquid crystal displays.

Referring to FIG. 3, the present invention also provides an LED light bard driving circuit, which comprises a constant current driving chip 30, a plurality of resistors R, an LED light bar 10, a power source 20, and a PWM control source 40. The constant current driving chip 30 comprises a plurality of constant current driving modules 32 and each of the constant current driving modules 32 comprises first to third pins 1-3. The LED light bar 10 has a positive terminal and a negative terminal. The positive terminal of the LED light bar 10 is electrically connected to the power source 20. Each of the resistors R has an end connected to the third pin 3 of one of the constant current driving modules 32 and an opposite end connected to a ground line. The first pin 1 of the constant current driving module 32 that comprises the resistor R connected thereto is connected to the negative terminal of the LED light bar 10. The second pin 2 is connected to the PWM control source 40.

The resistances of the resistors R are each determined according to the desired luminance of an LED light bar 10 associated therewith. In other words, through setting the resistances of the resistors R, electrical current flowing through the LED light bar 10 can be adjusted thereby adjusting the lighting luminance of the LED light bar 10. In the instant preferred embodiment, the constant current driving modules 32 contained in the constant current driving chip 30 comprises are of a number greater than two. The resistors R have a number corresponding to the number of the constant current driving modules 32 contained in the constant current driving chip 30 so as to ensure that at least two constant current driving modules 32 are simultaneously driving a single LED light bar 10.

Each of the constant current driving modules 32 comprises a field-effect transistor Q and a voltage comparator D electrically connected to the field-effect transistor Q. The field-effect transistor Q comprises a gate terminal g, a source terminal s, and a drain terminal d. The drain terminal d is electrically connected to the negative terminal of the LED light bar 10. The gate terminal g is electrically connected to the voltage comparator D. The source terminal s is electrically connected to the resistor R on the third pin 3 of the constant current driving module 32. Using conduction and cutoff of the field-effect transistor Q to control the LED light bar 10 to conduct on or cut off is safe and reliable, providing the switch with elongated lifespan. The voltage comparator D comprises a positive pin, a negative pin, and an output pin. The positive pin is electrically connected to the PWM control source 40. The negative pin is electrically connected to the source terminal s of the field-effect transistor Q. The output pin is electrically connected to the gate terminal g of the field-effect transistor Q. A stable voltage is supplied through the voltage comparator D to drive the field-effect transistor Q.

The PWM control source 40 supplies high level and low level. The high level is greater than voltage of a source terminal s when a field-effect transistor Q is normally conducted on. The low level is less than the voltage of the source terminal s when the field-effect transistor Q is normally conducted on so as to ensure that when a high level is applied to the positive pin, the voltage comparator D outputs a high level to drive the field-effect transistor Q and when a low level is applied to the positive pin, the voltage comparator output a low level and the low level is incapable of conducting on the field-effect transistor Q. The output voltage of the voltage comparator D is greater than a threshold voltage of the field-effect transistor Q in order to ensure that the output voltage of the voltage comparator can properly drive the field-effect transistor Q to switch the field-effect transistor Q between conduction condition and cutoff condition.

The operation of the LED light bar driving circuit according to the present invention is as follows. The PWM control source 40 and the power source 10 are activated and the PWM control source 10 outputs a high level according to a practical need, so that the voltage comparator D outputs a high level to drive the field-effect transistor Q for switching the field-effect transistor Q from a cutoff condition to a conduction condition, whereby the LED light bar 10 and the plurality of constant current driving modules 32 form a loop and the LED light bar 10 is driven to give off light, in which the plurality of constant current driving modules 32 splits the electrical current flowing through the LED light bar 10.

In summary, the present invention provides a method for multiplying current of an LED light bar that uses two or more than two constant current driving modules to simultaneously a single LED light bar so as to increase the electrical current flowing through the LED light bar and improve the luminance of the LED light bar so as to provide a brighter backlight source to meet the need of large-sized liquid crystal displays. The present invention also provides an LED light bar driving circuit, which has a simple structure, increases the electrical current flowing through an LED light bar, and improves the luminance of the LED light bar so as to provide a brighter backlight to meet the need of large-sized liquid crystal displays.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A method for multiplying current of a light emitting diode (LED) light bar, comprising the following steps:

(1) providing a constant current driving chip and a plurality of resistors, wherein the constant current driving chip comprises a plurality of constant current driving modules respectively corresponding to the plurality of resistors and each of the constant current driving modules comprises first to third pins;

(2) providing a single LED light bar that comprises a plurality of LEDs, a power source, and a single pulse width modulation (PWM) control source, wherein the LED light bar has a positive terminal and a negative terminal;

(3) connecting an end of a first one of the resistors to the third pin of an associated one of the constant current driving modules and an opposite end to a ground line, connecting the first pin of the associated one of the constant current driving modules to the negative terminal of the single LED light bar, connecting the second pin of the associated one of the constant current driving modules to the single PWM control source, and connecting the positive terminal of the single LED light bar to the power source;

(4) repeating step (3) in such a way as to connect an end of a second one of the resistors to the third pin of an associated one of the constant current driving modules and an opposite end to the ground line, connecting the first pin of the associated one of the constant current driving modules to the negative terminal of the single LED light bar, connecting the second pin of the associated one of the constant current driving modules to the single PWM control source, and connecting the positive terminal of the LED light bar to a power source so as to have the plurality of constant current driving modules electrically connected to the single LED light bar, the plurality of resistors, the power source, and the single PWM control source, wherein the plurality of the constant current driving modules is collectively connected in parallel between the negative terminal of the single LED light source and the single PWM control source with the plurality of the resistors grounded by individually connecting to the ground line and wherein each of the plurality of the constant current driving modules supplies a current flowing completely through the plurality of LEDs of the LED light bar; and (5) activating the power source and the PWM control source in order to allow the plurality of constant current driving modules to be simultaneously activated by a single signal from the PWM control source to supply the currents to the single LED light bar at the same time to drive the single LED light bar to give off light, wherein the currents supplied from the plurality of constant current driving modules that are simultaneously activated by a single signal from the PWM control source simultaneously flow through the single LED light bar to enhance brightness achieved with the LED light bar in such a way that the current supplied from each of the plurality of constant current driving modules flows completely through the LED light bar.

2. The method for multiplying current of an LED light bar as claimed in claim 1, wherein the constant current driving modules contained in the constant current driving chip are of a number greater than two and the resistors have a number corresponding to the number of the constant current driving modules contained in the constant current driving chip.

3. The method for multiplying current of an LED light bar as claimed in claim 2, wherein each of the constant current driving modules comprises a field-effect transistor and a voltage comparator electrically connected to the field-effect transistor, the field-effect transistor comprising a gate terminal, a source terminal, and a drain terminal, the drain terminal being electrically connected to the negative terminal of the LED light bar, the gate terminal being electrically connected to the voltage comparator, the source terminal being electrically connected to the resistor on the third pin of the constant current driving module.

4. The method for multiplying current of an LED light bar as claimed in claim 3, wherein the voltage comparator comprises a positive pin, a negative pin, and an output pin, the positive pin being electrically connected to the PWM control source, the negative pin being electrically connected to the source terminal of the field-effect transistor, the output pin being electrically connected to the gate terminal of the field-effect transistor.

5. The method for multiplying current of an LED light bar as claimed in claim 4, wherein the PWM control source supplies high level and low level, the high level being greater than voltage of the source terminal when the field-effect transistor is normally conducted on, the low level being less than the voltage of the source terminal when the field-effect transistor is normally conducted on, the output voltage of the voltage comparator being greater than a threshold voltage of the field-effect transistor.

6. An LED (Light Emitting Diode) light bar driving circuit, comprising a constant current driving chip, a plurality of resistors, a single LED light bar that comprises a plurality of LEDs, a power source, and a single pulse width modulation (PWM) control source, the constant current driving chip comprising a plurality of constant current driving modules respectively associated with the plurality of resistors, each of the constant current driving modules comprising first to third pins, the LED light bar having a positive terminal and a negative terminal, the positive terminal of the LED light bar being electrically connected to the power source, each of the resistors having an end connected to the third pin of an associated one of the constant current driving modules and an opposite end connected to a ground line, the first pin of the associated one of the constant current driving modules that comprises the resistor connected thereto being connected to the negative terminal of the LED light bar, the second pin being connected to the PWM control source, wherein the plurality of the constant current driving modules is collectively connected in parallel between the negative terminal of the single LED light source and the single PWM control source with the plurality of the resistors grounded by individually connecting to the ground line and wherein each of the plurality of the constant current driving modules supplies a current flowing completely through the plurality of LEDs of the LED light bar and the plurality of constant current driving modules are simultaneously activated by a single signal from the PWM control source to supply the currents to the LED light bar at the same time, wherein the currents supplied from the plurality of constant current driving modules that are simultaneously activated by a single signal from the PWM control source simultaneously flow through the single LED light bar to enhance brightness achieved with the LED light bar in such a way that the current supplied from each of the plurality of constant current driving modules flows completely through the LED light bar.

7. The LED light bar driving circuit as claimed in claim 6, wherein the constant current driving modules contained in the constant current driving chip are of a number greater than two and the resistors have a number corresponding to the number of the constant current driving modules contained in the constant current driving chip.

8. The LED light bar driving circuit as claimed in claim 6, wherein each of the constant current driving modules comprises a field-effect transistor and a voltage comparator electrically connected to the field-effect transistor, the field-effect transistor comprising a gate terminal, a source terminal, and a drain terminal, the drain terminal being electrically connected to the negative terminal of the LED light bar, the gate terminal being electrically connected to the voltage comparator, the source terminal being electrically connected to the resistor on the third pin of the constant current driving module.

9. The LED light bar driving circuit as claimed in claim 8, wherein the voltage comparator comprises a positive pin, a negative pin, and an output pin, the positive pin being electrically connected to the PWM control source, the negative pin being electrically connected to the source terminal of the field-effect transistor, the output pin being electrically connected to the gate terminal of the field-effect transistor.

10. The LED light bar driving circuit as claimed in claim 6, wherein the PWM control source supplies high level and low level, the high level being greater than voltage of the source terminal when the field-effect transistor is normally conducted on, the low level being less than the voltage of the source terminal when the field-effect transistor is normally conducted on, the output voltage of the voltage comparator being greater than a threshold voltage of the field-effect transistor.

11. A method for multiplying current of a light emitting diode (LED) light bar, comprising the following steps:

(1) providing a constant current driving chip and a plurality of resistors, wherein the constant current driving chip comprises a plurality of constant current driving modules respectively corresponding to the plurality of resistors and each of the constant current driving modules comprises first to third pins;

(2) providing a single LED light bar that comprises a plurality of LEDs, a power source, and a single pulse width modulation (PWM) control source, wherein the LED light bar has a positive terminal and a negative terminal;

(3) connecting an end of a first one of the resistors to the third pin of an associated one of the constant current driving modules and an opposite end to a ground line, connecting the first pin of the associated one of the constant current driving modules to the negative terminal of the single LED light bar, connecting the second pin of the associated one of the constant current driving modules to the single PWM control source, and connecting the positive terminal of the single LED light bar to the power source;

(4) repeating step (3) in such a way as to connect an end of a second one of the resistors to the third pin of an associated one of the constant current driving modules and an opposite end to the ground line, connecting the first pin of the associated one of the constant current driving modules to the negative terminal of the single LED light bar, connecting the second pin of the associated one of the constant current driving modules to the single PWM control source, and connecting the positive terminal of the LED light bar to a power source so as to have the plurality of constant current driving modules electrically connected to the single LED light bar, the plurality of resistors, the power source, and the single PWM control source, wherein the plurality of the constant current driving modules is collectively connected in parallel between the negative terminal of the single LED light source and the single PWM control source with the plurality of the resistors grounded by individually connecting to the ground line and wherein each of the plurality of the constant current driving modules supplies a current flowing completely through the plurality of LEDs of the LED light bar; and (5) activating the power source and the PWM control source in order to allow the plurality of constant current driving modules to be simultaneously activated by a single signal from the PWM control source to supply the currents to the single LED light bar at the same time to drive the single LED light bar to give off light, wherein the currents supplied from the plurality of constant current driving modules that are simultaneously activated by a single signal from the PWM control source simultaneously flow through the single LED light bar to enhance brightness achieved with the LED light bar in such a way that the current supplied from each of the plurality of constant current driving modules flows completely through the LED light bar;

wherein the constant current driving modules contained in the constant current driving chip are of a number greater than two and the resistors have a number corresponding to the number of the constant current driving modules contained in the constant current driving chip;

wherein each of the constant current driving modules comprises a field-effect transistor and a voltage comparator electrically connected to the field-effect transistor, the field-effect transistor comprising a gate terminal, a source terminal, and a drain terminal, the drain terminal being electrically connected to the negative terminal of the LED light bar, the gate terminal being electrically connected to the voltage comparator, the source terminal being electrically connected to the resistor on the third pin of the constant current driving module;

wherein the voltage comparator comprises a positive pin, a negative pin, and an output pin, the positive pin being electrically connected to the PWM control source, the negative pin being electrically connected to the source terminal of the field-effect transistor, the output pin being electrically connected to the gate terminal of the field-effect transistor; and wherein the PWM control source supplies high level and low level, the high level being greater than voltage of the source terminal when the field-effect transistor is normally conducted on, the low level being less than the voltage of the source terminal when the field-effect transistor is normally conducted on, the output voltage of the voltage comparator being greater than a threshold voltage of the field-effect transistor.

* * * * *